US012383078B2

(12) United States Patent
Srour et al.

(10) Patent No.: US 12,383,078 B2
(45) Date of Patent: Aug. 12, 2025

(54) PLAY YARD WITH REMOVABLE PADDED FLOOR

(71) Applicant: Dream On Me, Inc., Piscataway Township, NJ (US)

(72) Inventors: Joey Srour, Brooklyn, NY (US); Robert Omansky, Fairfield, IA (US); Corey Campbell, Wadsworth, OH (US); Cory Everman, Fairlawn, OH (US); David Campbell, Bolivar, OH (US)

(73) Assignee: Dream On Me, Inc., Piscataway Township (JE)

( * ) Notice: Subject to any disclaimer, the term of this patent is extended or adjusted under 35 U.S.C. 154(b) by 385 days.

(21) Appl. No.: 17/890,678

(22) Filed: Aug. 18, 2022

(65) Prior Publication Data

US 2024/0057787 A1 Feb. 22, 2024

(51) Int. Cl.
*A47D 13/06* (2006.01)

(52) U.S. Cl.
CPC ..... *A47D 13/066* (2013.01); *A47D 13/061* (2013.01); *A47D 13/063* (2013.01); *A47D 13/06* (2013.01); *A47D 13/065* (2013.01)

(58) Field of Classification Search
CPC ..... A47G 9/0238; A47G 9/0246; A47G 9/02; A47G 9/0261; A47G 2009/0269; A47G 9/0284; A47G 2009/0276; A47G 9/0207; A47G 9/0215; A47G 9/0223; A47G 9/023; A47G 9/0253; A47C 31/10; A47C 31/105; A47C 31/007; Y10S 5/923; A47D 13/068; A47D 13/06; A47D 13/061; A47D 13/063; A47D 13/065; A47D 13/066; A47D 15/003; A47D 9/016; A47D 11/007; A47D 9/005; A47D 7/02; A47D 15/008; A47D 7/04; A47D 7/00; A47D 7/002; A47D 9/012; A47D 15/001; A47D 7/03; A47D 11/005; A47D 7/01; A47D 11/00; A47D 9/04; A47D 9/053; A47D 9/057; A47D 1/008; A47D 1/0085; A47D 13/00; A47D 7/005; A47D 7/007; A47D 9/00; A47D 9/02
USPC ..... D6/602; 5/99.1, 98.1
See application file for complete search history.

(56) References Cited

U.S. PATENT DOCUMENTS

| | | | |
|---|---|---|---|
| 1,487,341 | A | 3/1924 | Lange |
| 4,750,223 | A | 6/1988 | D'Arcy et al. |
| 5,163,191 | A | 11/1992 | Chan |
| 6,131,218 | A | 10/2000 | Wang |
| 6,430,762 | B1 | 8/2002 | Cheng |
| RE39,136 | E | 6/2006 | Tharalson et al. |

(Continued)

FOREIGN PATENT DOCUMENTS

| | | |
|---|---|---|
| CN | 204071384 | 1/2015 |

OTHER PUBLICATIONS

Amazon.com : Pamo Babe Travel Crib—Lightweight Baby Playpen with Bassinet, Portable Mini Playard : Baby (Year: 2025).*

*Primary Examiner* — Justin C Mikowski
*Assistant Examiner* — Deborah Talitha Gedeon
(74) *Attorney, Agent, or Firm* — Frost Brown Todd LLP; Alexander J. Johnson

(57) ABSTRACT

A play yard comprising: a play yard frame body defining an enclosed area; a tunnel located below said enclosed area; and a removable padded floor assembly. The removable padded floor assembly is removably placeable within said tunnel.

15 Claims, 7 Drawing Sheets

(56) References Cited

U.S. PATENT DOCUMENTS

| | | | | |
|---|---|---|---|---|
| 7,216,379 | B2 * | 5/2007 | Tharalson | A47D 7/02 5/93.2 |
| 8,201,291 | B2 | 6/2012 | Burns et al. | |
| 8,955,174 | B1 | 2/2015 | Lawlor et al. | |
| 9,332,860 | B2 | 5/2016 | Rong et al. | |
| 9,801,473 | B2 | 10/2017 | Jackson et al. | |
| 9,848,714 | B2 | 12/2017 | Burns et al. | |
| 10,064,499 | B2 | 9/2018 | Szymanski et al. | |
| 10,149,551 | B2 | 12/2018 | Long | |
| 10,188,221 | B2 | 1/2019 | Rampton et al. | |
| D899,130 | S | 10/2020 | Dolk et al. | |
| 2002/0078499 | A1 * | 6/2002 | Cheng | A47D 13/063 5/93.1 |
| 2005/0034232 | A1 * | 2/2005 | Martin | A47D 7/02 5/93.1 |
| 2009/0077742 | A1 * | 3/2009 | Burns | A47D 9/016 5/99.1 |
| 2010/0162484 | A1 * | 7/2010 | Thomas | A47D 9/016 5/93.1 |
| 2013/0117930 | A1 | 5/2013 | Hsu | |
| 2016/0286982 | A1 * | 10/2016 | Smith | A47D 9/016 |
| 2016/0309914 | A1 * | 10/2016 | Burns | A47D 9/005 |

* cited by examiner

PLAY YARD WITH REMOVABLE PADDED FLOOR

FIELD OF THE INVENTION

This invention relates to a play yard for young children. More particularly, the invention relates to a play yard that includes a removable padded floor. Most particularly, the invention relates to a play yard with a removable padded floor located in a tunnel below the lower fabric floor of the play yard such that any child within the play yard cannot access the removable padded floor.

BACKGROUND OF THE INVENTION

A conventional play yard or portable crib typically comprises a frame body which includes a support frame, a stand mounted on the bottom of the support frame, a fabric floor with mesh walls coming up from the support frame to create an enclosure, and a mattress secured or securable within the support frame. Thus, the play yard or portable crib has an inner space to receive an infant or a baby so that the infant or baby can play within the enclosure created by the fabric floor, mesh walls, and the support frame or so that they can sleep on the mattress.

Under the current safety standard, the mattress provided with a play yard is limited in thickness which parents perceive as not comfortable enough for a child and thus have historically decided to add an additional mattress or extra padding to increase the comfort for the child. However, extra padding or an incorrectly sized mattress within the play yard or portable crib can cause safety issues. Such safety issues include entrapment of the infant between the incorrectly sized mattress or padding and the fabric floors or mesh walls of the play yard or portable crib which can lead to asphyxiation/suffocation of the infant. The safety standard requires a warning against the addition of extra padding or mattresses however, consumers continue to ignore that warning and add extra padding or incorrectly sized mattresses leading to the death of infants. There has even been a submission to the Consumer Product Safety Commission entitled "Petition Requesting Rulemaking on Supplemental Mattresses for Play Yards with Non-Rigid Sides" that requested the Commission to issue a ban on supplemental mattresses thicker than 1.5 inches for play yards with non-rigid sides because CPSC research indicates that incorrectly sized mattresses create a suffocation hazard because they create a gap between the mattress pad sides and the sides of the portable crib where a baby can suffocate when the baby's head or torso falls in such a gap while lying in a prone position.

Therefore, there is a need in the art to create a play yard or portable crib that provides enhanced comfort to the infant while also not providing any opportunities for the infant to get entrapped by a mattress or padding.

SUMMARY OF THE INVENTION

An embodiment of the present invention provides a play yard comprising: a play yard frame body defining an enclosed area; a tunnel located below said enclosed area; and a removable padded floor assembly; wherein the removable padded floor assembly is removably placeable within said tunnel.

Another embodiment of the present invention provides a play yard as in any embodiment above, wherein said play yard frame body includes an upper frame body and a lower frame body; wherein said upper frame body includes four vertical arms, two horizontal side arms, and two horizontal end arms; and wherein said lower frame body includes four corner brackets, four diagonal arms, two lower horizontal arms, and a release mechanism.

Another embodiment of the present invention provides a play yard as in any embodiment above, wherein each of the horizontal side and horizontal end arms are positioned and secured between two of the four vertical arms; wherein the four diagonal arms are each individually securable within one of the four corner brackets; wherein each of the four diagonal arms and the two lower horizontal arms are each individually securable within the release mechanism; and wherein each of the four vertical arms are individually securable within the four corner brackets to connect said upper frame body to said lower frame body.

Another embodiment of the present invention provides a play yard as in any embodiment above, wherein said play yard further comprises a fabric crib body comprising two side mesh walls, two end mesh walls, four horizontal padded fabric sections, four vertical fabric sections, and a lower fabric floor section.

Another embodiment of the present invention provides a play yard as in any embodiment above, wherein the four horizontal padded fabric sections surround and enclose the horizontal side and horizontal end arms; wherein the four vertical fabric sections surround and enclose the four vertical arms; wherein the lower fabric floor section provides for a lower floor portion of the enclosed area; and wherein the two side mesh walls and the two end mesh walls are surround by the four horizontal padded fabric sections, the four vertical fabric sections, and the lower fabric floor section to form wall portions of the enclosed area.

Another embodiment of the present invention provides a play yard as in any embodiment above, wherein the tunnel includes two tunnel side walls, two tunnel end walls, and a tunnel bottom floor, and wherein the lower fabric floor section of the enclosed area comprises an upper surface of said tunnel.

Another embodiment of the present invention provides a play yard as in any embodiment above, wherein one or both of said tunnel end walls are openable tunnel end walls, wherein one or both of said openable tunnel end walls include a stitched shut top portion, two non-stitched side portions, and a non-stitched bottom portion; wherein each said non-stitched side portion and said non-stitched bottom portion contain securement means; and wherein adjacent said securement means there are complementary securement means located on said tunnel side walls and said tunnel bottom floor.

Another embodiment of the present invention provides a play yard as in any embodiment above, wherein when said securement means on said non-stitched side portions and said non-stitched bottom portion of said one or both of said openable tunnel end walls are matted with said complementary securement means on said tunnel side walls and said tunnel bottom floor, then said one or both of said openable tunnel end walls become closed end walls.

Another embodiment of the present invention provides a play yard as in any embodiment above, wherein one or both of said tunnel side walls are openable tunnel side walls, wherein one or both of said openable tunnel side walls include a stitched shut top portion, two non-stitched side portions, and a non-stitched bottom portion; wherein each said non-stitched side portion and said non-stitched bottom portion contain securement means; and wherein adjacent said securement means there are complementary securement means located on said tunnel end walls and said tunnel bottom floor.

Another embodiment of the present invention provides a play yard as in any embodiment above, wherein when said securement means on said non-stitched side portions and said non-stitched bottom portion of said one or both of said openable tunnel side walls are matted with said complementary securement means on said tunnel end walls and said tunnel bottom floor, then said one or both of said openable tunnel side walls become closed side walls.

Another embodiment of the present invention provides a play yard as in any embodiment above, wherein said removable padded floor assembly includes a support board assembly, a foam padding assembly placed on said support board assembly, a cloth cover surrounding, and encasing said support board assembly and said foam padding assembly, and four floor securement means located at corners of the removable padded floor assembly.

Another embodiment of the present invention provides a play yard as in any embodiment above, wherein the support board assembly is a four-piece support board assembly and wherein the foam padding assembly is a four-piece foam padding assembly.

Another embodiment of the present invention provides a play yard as in any embodiment above, wherein the tunnel bottom floor contains at least two complementary padded floor securement means located along an outside surface of the bottom floor, and wherein said floor securement means of the padded floor assembly will mate with said complementary floor securement means located along the outside surface of the bottom floor when said removable padded floor assembly is removably placed within said tunnel.

Another embodiment of the present invention provides a play yard as in any embodiment above, wherein said fabric crib body further includes a bassinet connection portion positioned along a mid-height of each of the side and end mesh walls; wherein each bassinet connection portion includes a bassinet securement means; and wherein said removable padded floor assembly includes a complementary bassinet securement means located around an upper periphery of the padded floor assembly Another embodiment of the present invention provides a play yard as in any embodiment above, wherein said bassinet securement means are removably securable with said complementary bassinet securement means of the padded floor assembly.

BRIEF DESCRIPTION OF THE DRAWINGS

For a more complete understanding of the features and advantages of the present invention, reference is now made to the detailed description of the invention along with the accompanying figures in which.

DETAILED DESCRIPTION OF ILLUSTRATIVE EMBODIMENTS

Figure 1:
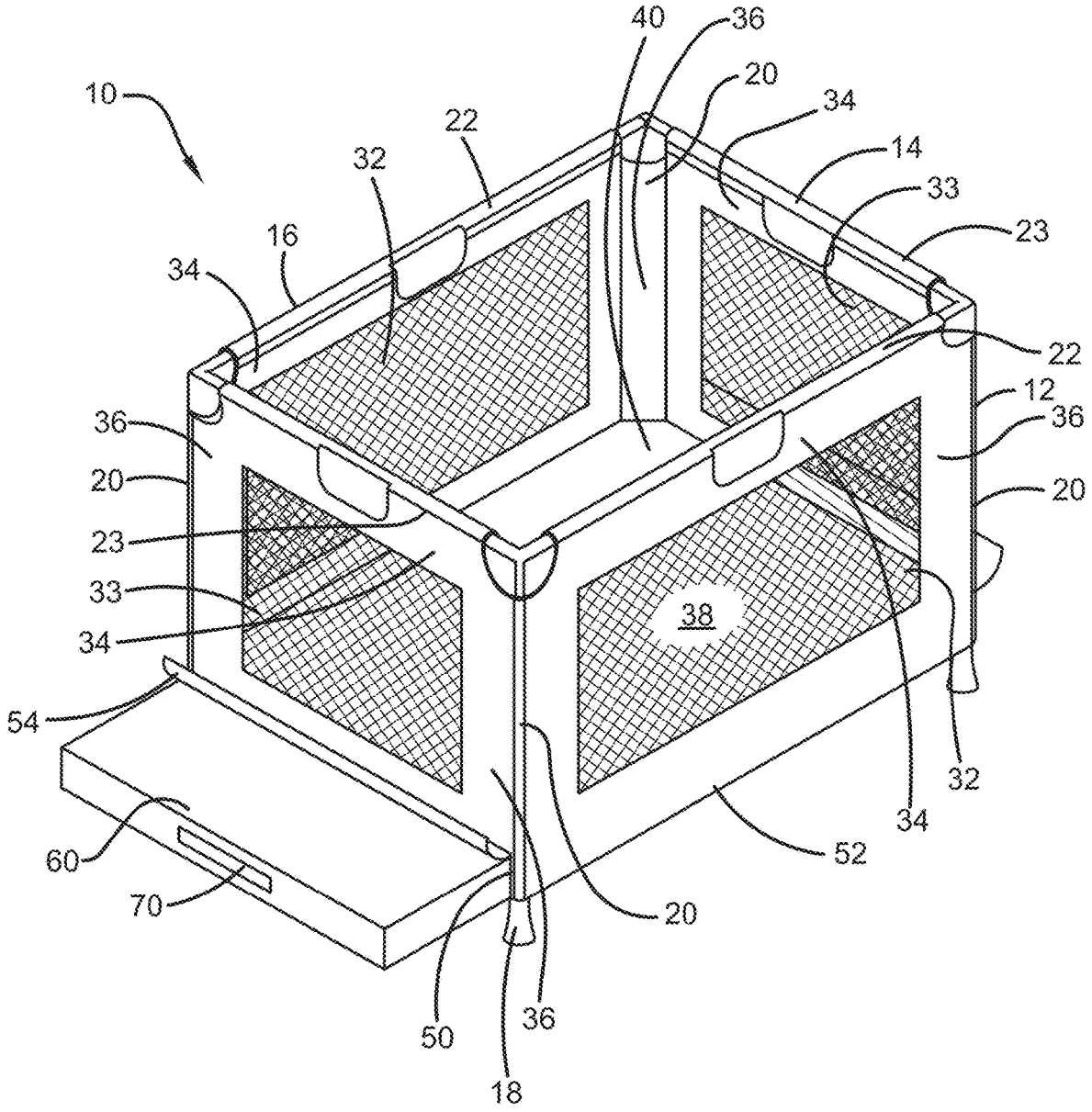
FIG. 1 is a perspective view of one embodiment of the play yard with a removable padded floor of the present invention wherein the removeable padded floor is placeable through an end wall of the tunnel.
Figure 2:
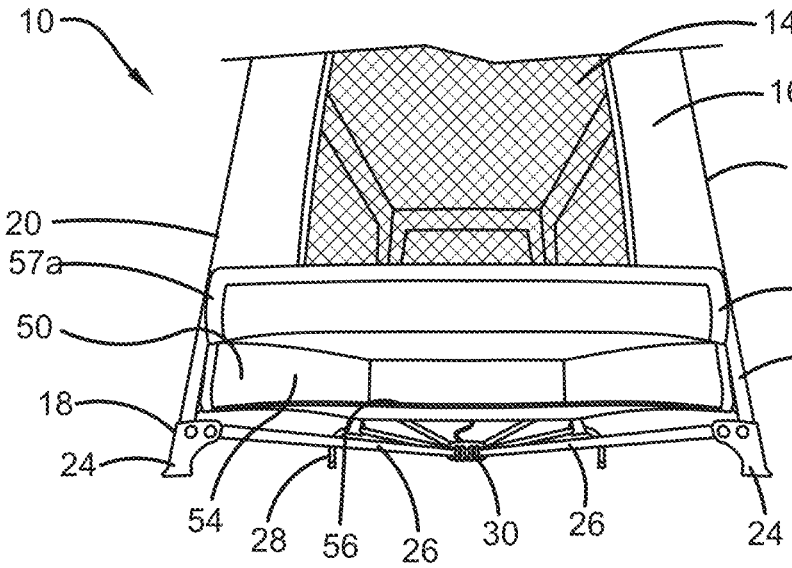
FIG. 2 is a plan view of the embodiment of FIG. 1 wherein the play yard of the present invention is on its end prior to placement of the removable padded floor into the tunnel.

A play yard with a removable padded floor made in accordance with the present invention is indicated by the numeral 10. Play yard 10 comprises a frame body 12 with a fabric and/or mesh crib body 14 as shown in FIG. 1. While the present invention is not defined by the specifics of the frame body 12, a typical frame body 12 includes an upper frame body 16 and a lower frame body 18 as shown in FIGS. 1 and 2. The upper frame body 16 includes four vertical arms 20, two horizontal side arms 22, and two horizontal end arms 23. Each of the horizontal arms 22 and 23 are positioned and secured between two of the vertical arms 20. The lower frame body 18 includes four corner brackets 24, four diagonal arms 26, two lower horizontal arms 28, and a release mechanism 30. Although not visible in the drawings of the present invention, it is contemplated that the horizontal arms 22 and 23 are two pieces arms with a locking mechanism securing the two pieces together at the center portion of each horizontal arm 22 and 23 as is common in the field.

Each of the four vertical arms 20 are individually securable within the four corner brackets 24 to connect the upper frame body 16 to the lower frame body 18. The four diagonal arms 26 are also individually securable within the four corner brackets 24 as best seen in FIG. 2. As also shown in the FIG. 2, the four diagonal arms 26 and the two lower horizontal arms 28 are also individually securable within the release mechanism 30. The ends of the two lower horizontal arms 28 are curved to allow for easy placement on a floor surface.

While the present invention is not defined by the specifics of the fabric crib body 14, a typical fabric crib body includes two side mesh walls 32, two end mesh walls 33, four horizontal padded fabric sections 34, four vertical fabric sections 36, and a lower fabric floor section 38 as shown in FIG. 1. In some embodiments, the side mesh walls 32 and/or the end mesh walls 33 could also be made from a fabric material instead of the mesh material as shown in the drawings. The four horizontal padded fabric sections 34 surround and enclose the horizontal arms 22 and 23 and the four vertical fabric sections 36 surround and enclose the four vertical arms 20. The lower fabric floor section 38 provides the bottom surface of the enclosed area 40 of the play yard 10 and the mesh walls 32 and 33 are surrounded by the four horizontal padded fabric sections 34, the four vertical fabric sections 36, and the lower fabric floor section 38.

Figure 3A:
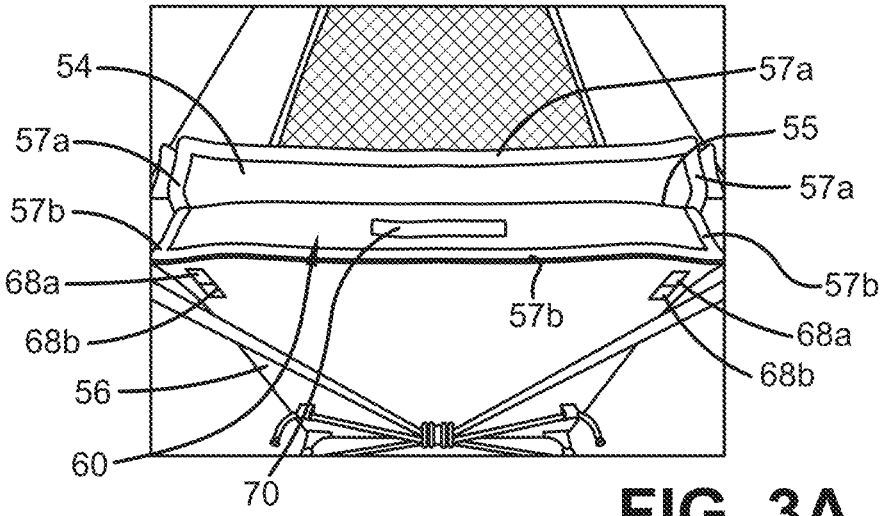
FIG. 3A is a plan view of the embodiment of FIG. 1 wherein the play yard of the present invention is on its end after the removable padded floor has been placed within the tunnel but prior to the end wall of the tunnel being secured shut.
Figure 3B:
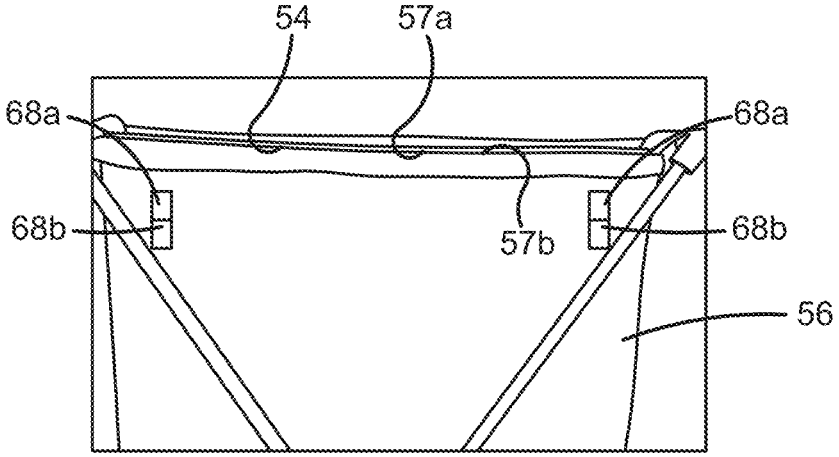
FIG. 3B is a plan view of the embodiment of FIG. 1 wherein the play yard of the present invention is on its end after the removable padded floor has been placed within the tunnel and after the end wall of the tunnel has been secured shut.

Play yard 10 additionally includes fabric tunnel 50 located below the lower fabric floor section 38. Tunnel 50 includes two tunnel side walls 52, two tunnel end walls 54, and a bottom tunnel floor 56 as best shown in FIGS. 1 and 2. In one or more embodiments of the present invention, one or both end walls 54 are openable to receive a removable padded floor assembly 60. Within the context of the present application, the term openable as related to the end walls 54 is defined to mean that a top portion of one or both end walls 54 is secured shut with stitching 55 and the side and bottom portions of one or both end walls 54 are not secured shut. FIG. 2 shows an embodiment of the present invention wherein an end wall 54 is in an opened position to receive a padded floor assembly 60. When one or more end walls 54 are openable, the sides and bottom portion of the openable end wall 54 will contain securement means 57*a*, with a related securement means 57*b* located adjacent the sides of the side wall 52 and along a bottom portion of the bottom floor 56 as best shown in FIGS. 3A and 3B. In one or more embodiments, the securement means 57*a* and 57*b* can include a hook and loop type fasteners, male and female snap fasteners, and male and female zip fasteners.

Figure 4:
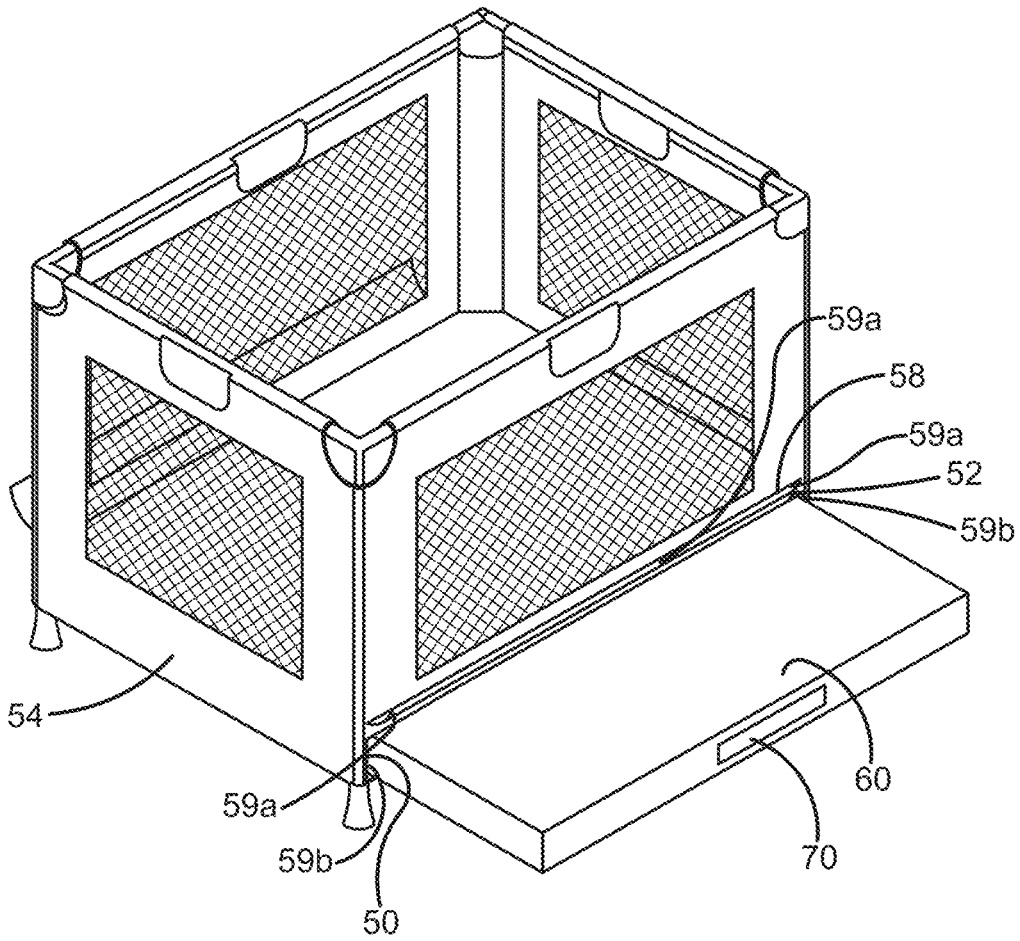
FIG. 4 is a perspective view of another embodiment of the play yard with a removable padded floor of the present invention wherein the removable padded floor is placeable through a side wall of the tunnel.

In one or more embodiments of the present invention, one or both side walls 52 are openable to receive a removable padded floor assembly 60 as best shown in FIG. 4. Within the context of the present application, the term openable as related to the side walls 52 is defined to mean that a top portion of one or both side walls 52 is secured shut with stitching 58 and the side and bottom portions of one or both side walls 52 are not secured shut. FIG. 4 shows wherein a side wall 52 is in an opened position to receive a padded floor assembly. When one or more side walls 52 are openable, the sides and bottom portion of the side wall 52 will contain a securement means 59*a*, with a related securements means 59*b* located adjacent the sides of the side wall 52 and along a bottom portion of the bottom floor 56 as best shown in FIG. 4. In one or more embodiments, the securement means 59*a* and 59*b* can include hook and loop type fasteners, male and female snap fasteners, and male and female zip fasteners.

Figure 5A:
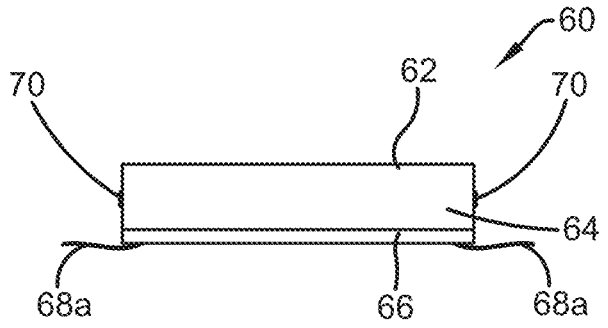
FIG. 5A is a plan side view of one embodiment of the removable padded floor assembly of the play yard of the present invention.
Figure 5B:
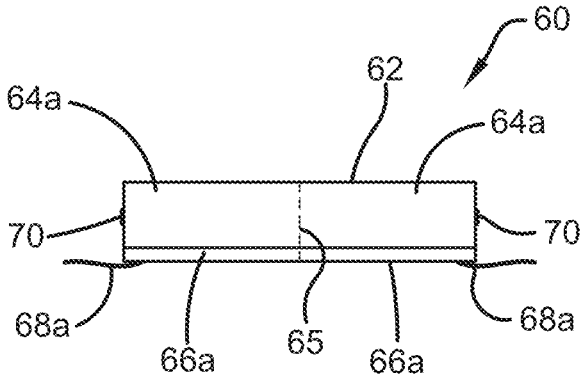
FIG. 5B is a plan side view of another embodiment of the removable padded floor assembly of the play yard of the present invention.
Figure 5C:
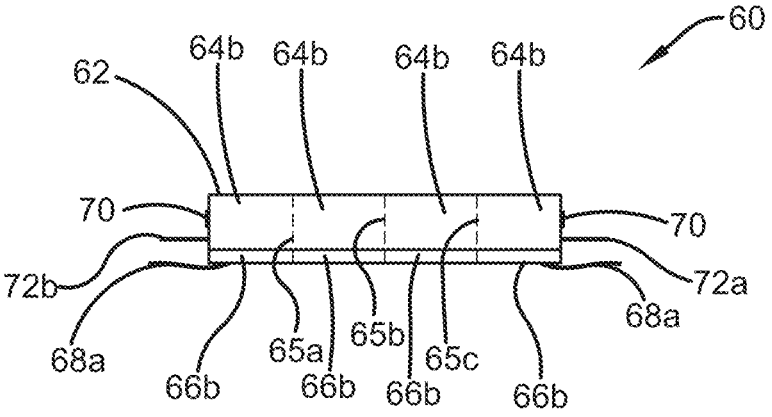
FIG. 5C is a plan side view of yet another embodiment of the removable padded floor assembly of the play yard of the present invention.

FIGS. 5A, 5B, and 5C show three different embodiments of the padded floor assembly 60. In every embodiment of the padded floor assembly 60, said assembly 60 is comprised of four main elements: cloth cover 62, foam padding assembly 64, support board assembly 66, and securement means 68*a*. In one or more embodiments of the present invention, the padded floor assembly will also include at least one handle 70 located along at least one of the sides or along at least one of ends of the padded floor assembly 60.

As shown in FIG. 5A, this embodiment of the padded floor assembly 60 includes a one-piece foam padding assembly 64 and a one-piece support board assembly 66. The one-piece foam padding assembly 64 and the one-piece support board assembly 66 are contained within the cloth covering 62. Although only two securement means 68*a* are shown adjacent the corners of the assembly 60, it is contemplated that the padded floor assembly 60 of FIG. 5A also has two additional securement means located adjacent the other corners of the assembly 60.

As shown in FIG. 5B, this embodiment of the padded floor assembly 60 includes a two-piece foam padding assembly 64*a* and a two-piece support board assembly 66*a*. It is important to note that in the embodiment of FIG. 5B, the two-piece foam padding assembly 64*a*, although separated into two pieces of foam padding, will operate in a comparable manner to the one-piece foam padding assembly shown in FIG. 5A when unfolded to a flat orientation. In a comparable manner, the two-piece support board assembly 66*a*, although separated into two pieces of support board, will operate in a comparable manner to the one-piece support board portion as shown in FIG. 5A when unfolded to a flat orientation. The assemblies 64*a* and 66*a* are contained within a cloth cover 62. The cloth cover 62 additionally includes stitching 65, located on the underside of the cloth cover 62, to split the padded floor assembly 60 into two attached but separate portions. Although only two securement means 68*a* are shown adjacent the corners of the assembly 60, it is contemplated that the padded floor assembly 60 of FIG. 5B also has two additional securement means located adjacent the other corners of the assembly 60.

As shown in FIG. 5C, this embodiment of the padded floor assembly 60 includes a four-piece segmented foam assembly 64*b* and a four-piece segmented support board assembly 66*b*. It is important to note that in the embodiment of FIG. 5C, the four-piece foam padding assembly 64*b*, although separated into four pieces of foam padding, will operate in a comparable manner to the one-piece foam padding assembly of FIG. 5A when unfolded to a flat orientation. In a comparable manner, the four-piece support board assembly 66*b*, although separated into four pieces of support board, will operate in a comparable manner to the one-piece support board portion of FIG. 5A when unfolded to a flat orientation. The assemblies 64*b* and 66*b* are contained within a cloth cover 62. The cloth cover 62 additionally includes stitching 65*a*, 65*b*, and 65*c*, located on the underside of cloth cover 62, to split the padded floor assembly 60 into four attached but separate pieces. Although only two securement means 68*a* are shown adjacent the corners of the assembly 60, it is contemplated that the padded floor assembly 60 of FIG. 5C also has two additional securement means located adjacent the other corners of the assembly 60.

The padded floor assembly 60 will include positions where securement means 68*a* are located. If the play yard 10 is designed to have the padded floor assembly 60 placed within the tunnel 50 through the end walls 54, then the padded floor assembly 60 will include two securement means 68*a* along each end portion of the padded floor assembly 60, such as shown in FIGS. 5A, 5B, and 5C. If the play yard 10 is designed to have the padded floor assembly 60 be placed within the tunnel 50 through the side walls 52, then the padded floor assembly 60 will include two securement means 68*a* along each side portion of the padded floor assembly. In the embodiment shown in FIGS. 3A and 3B, the padded floor assembly 60 includes securement means 68*a*, with a related securements means 68*b* located along a bottom portion of the bottom floor 56. In one or more embodiments, the securement means 68*a* and 68*b* can include hook and loop type fasteners, male and female snap fasteners, and male and female zip fasteners. While both end portions of the padded floor assembly 60, or both side portions of the padded floor assembly 60 may include securement means 68*a* and 68*b*, it will only be necessary to secure one end or one side of the padded floor assembly 60 to secure assembly 60 within the tunnel 50 of the play yard 10.

The padded floor assembly 60 is oriented within the play yard 10 such that the foam assembly 64/64*a*/64*b* is closest to any child within the interior of play yard 10, when the play yard 10 is being used as either a play yard cover or a bassinet. In one or more embodiments of the present invention, the thickness of the padded floor assembly 60, including the foam assembly 64/64*a*/64*b*, the support board assembly 66/66*a*/66*b*, and the cloth cover 62 is from 0.5 inches to 4.0 inches, in other embodiments from 1.0 inches to 3.75 inches, and in yet other embodiments from 2.0 inches to 3.0 inches. In other embodiments, the thickness is greater that 0.5 inches, in other embodiments greater than 1.0 inches, and in yet other embodiments greater than 2.0 inches. In other embodiments, the thickness is less than 4.0 inches, in other embodiments less than 3.75 inches, and in yet other embodiments less than 3.25 inches. In other embodiments, the thickness of the padded floor assembly 60, including the foam assembly 64/64*a*/64*b*, the support board assembly 66/66*a*/66*b*, and the cloth cover 62 is 3.0 inches.

To set up play yard 10 for use, the following steps should be taken. To set up the enclosed area 40 of the play yard 10, the center of each horizontal side arm 22 needs to be grabbed and lifted upwards until the horizontal side arms 22 are in their fully extended and locked positions. Next, the center of each horizontal end arm 23 needs to be grabbed and lifted upwards until the horizontal end arms 23 are in their fully extended and locked positions. Next, the release mechanism 30 needs pushed down on until it locks the lower frame body 18 in place, this will set up the enclosed area 40 of the play yard 10.

Once the enclosed area 40 of play yard 10 has been setup, the next step is to install the padded floor assembly 60 within tunnel 50. In one or more embodiments, the play yard 10 is set on its end as shown in FIGS. 2 and 3 if the padded floor assembly 60 is to be installed through a tunnel end wall 54, or on its side if the padded floor assembly 60 is to be installed through a tunnel side wall 52. Next, by grabbing a handle 70 of the padded floor assembly 60, the padded floor assembly 60 can be slid into position within the tunnel 50. It is important to note that the padded floor assembly 60 should be slid within the tunnel 50 such that the foam padding 64 is positioned to be adjacent the lower fabric floor section 38 which also acts as the top wall of tunnel 50. Once in place, the securement means 68*a* should be secured to the securement means 68*b* as shown in FIGS. 3A and 3B. The last step of setting up play yard 10 for use is to secure the securement means 57*a* along sides and bottom portion of end wall 54 with the related securement means 57*b* located adjacent the sides of the side walls 52 and along a bottom portion of the bottom floor 56 to close access to tunnel 50 as best shown in FIG. 3B.

Figure 6:
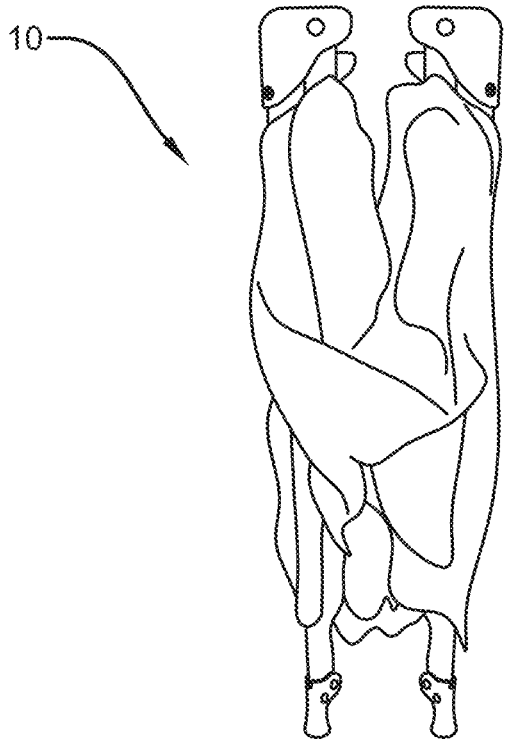
FIG. 6 is a plan view of a folded-up play yard of the present invention wherein the padded floor assembly has been removed from the tunnel.

To take apart play yard 10 when not in use, the first step will be to remove the padded floor assembly 60 from within tunnel 50 by placing the play yard 10 on its end as shown in FIG. 2, unsecuring the securement means 57*a* and 57*b*, unsecuring the securement means 68*a* and 68*b*, grabbing padded floor assembly 60 by handle 70 and pulling said assembly 60 from the tunnel 50. Once removed, the next step will be to push up on release mechanism 30 of the lower frame body 18 and release the locking mechanisms on the horizontal arms 22 and 23 to then allow for the frame body 12 to fold up as shown in FIG. 6.

Figure 7:
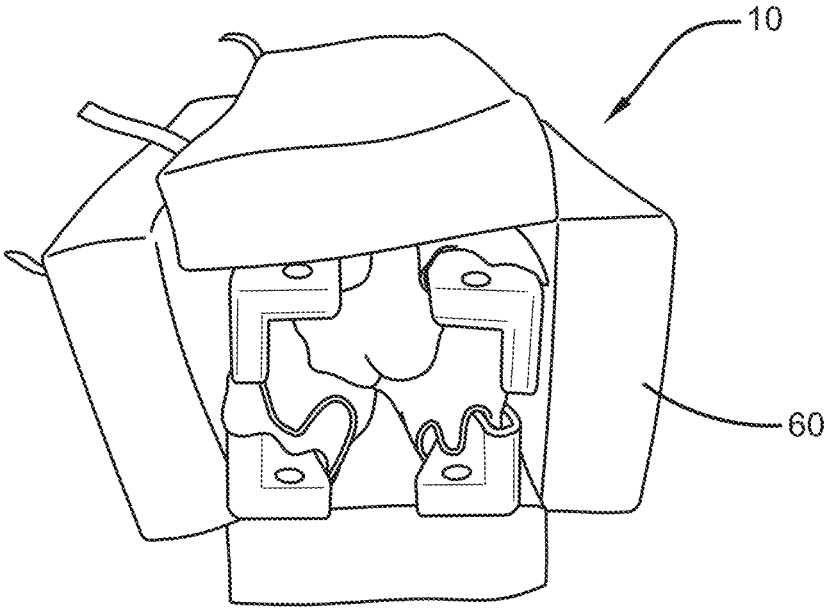
FIG. 7 is a perspective view of FIG. 6 with a padded floor assembly wrapped around the folded play yard and secured to itself for easy storage of the play yard.

In embodiments of the present invention that utilize the padded floor assembly 60 as shown in FIG. 5C, there is an additional step that can take place when storing the play yard 10 when not in use. The padded floor assembly 60 including the four-piece segmented foam assembly 64*b* and a four-piece segmented support board assembly 66*b* can be wrapped around the folded-up frame body 12 and fabric crib body 14 as shown in FIG. 7. The padded floor assembly 60 of FIG. 5C also includes two different securement means 72*a* and 72*b* that can be utilized to secure the padded floor assembly 60 when placed around the folded-up play yard 10 when it is not in use. In one or more embodiments, the securement means 72*a* and 72*b* can include hook and loop type fasteners, male and female snap fasteners, and male and female zip fasteners.

Although not shown in any of the drawings, it is also contemplated that a removable mattress can be supplied with the play yard 10 of the present invention that would be placeable on top of the lower fabric floor section 38 of the enclosed area 40 of the play yard 10 This mattress would be relatively thin to not provide any opportunity for a child/infant to become entrapped underneath and cause a safety hazard. It is contemplated that such a mattress will be less than 1 inch thick and would also have the ability to receive a fitted sheet.

Figure 8A:
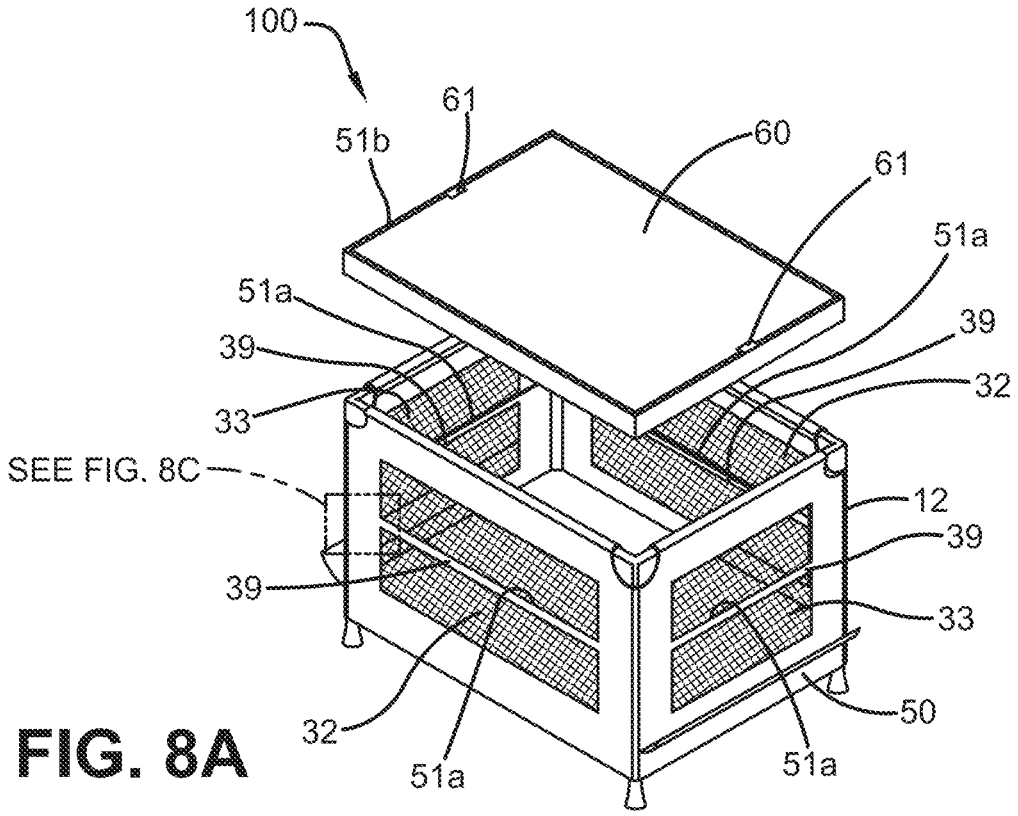
FIG. 8A is a perspective view of one embodiment of the present invention with the removable padded floor not secured at the mid-height of the sides of the play yard.
Figure 8B:
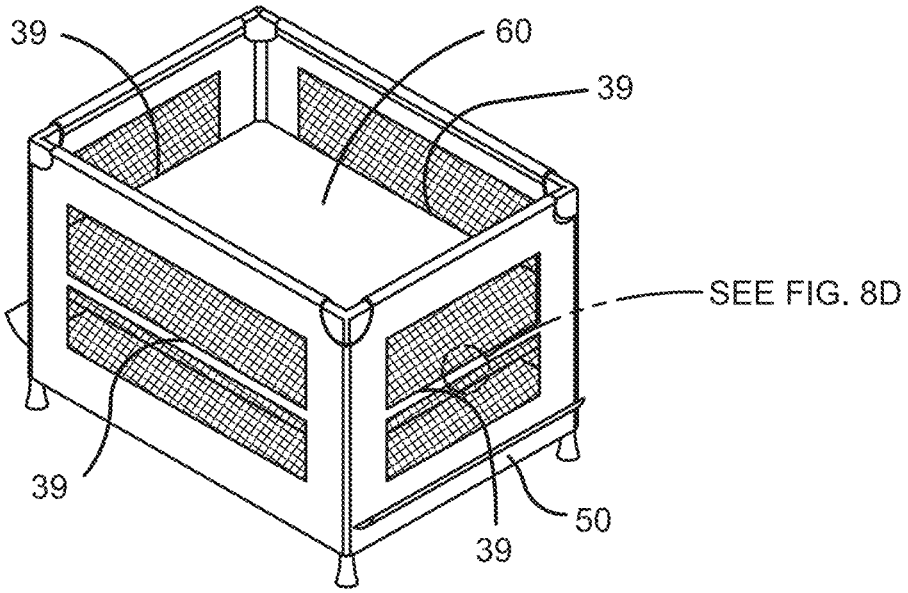
FIG. 8B is a perspective view of FIG. 8A with the removable padded floor secured at the mid-height of sides of the play yard such that the play yard can be used as a bassinet
Figure 9:
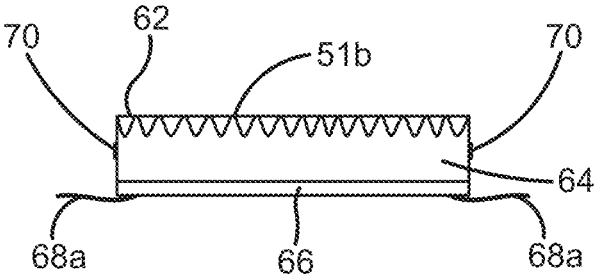
FIG. 9 is a plan side view of one embodiment of a removable padded floor assembly to be utilized with the play yard of FIG. 8A of the present invention.

In one embodiment of the present invention, the padded floor assembly 60 can also be secured in a position such that the play yard can be used as a bassinet. As shown in FIGS. 8A and 8B, the play yard 100 has all of the same features of play yard 10 as shown in FIG. 1. However, play yard 100 additionally has four bassinet connection portions 39 located at about the mid-height of each of the mesh walls 32 and 33. Also located along the interior portion of the four bassinet connections portions 39 is a zipper track 51*a*. As shown in FIG. 9, the padded floor assembly 60 of this embodiment will also contain a corresponding zipper track 51*b* located around the external upper periphery of the padded floor assembly 60. Although the padded floor assembly of FIG. 9 is similar to the padded floor assembly 60 of FIG. 5A, it is also contemplated that padded floor assembly 60 as shown in FIGS. 5B and 5C can contain a zipper track 51*b* located around its external upper periphery.

Although the above section discusses the use of zippers 51*a* and 51*b* to secure the padded floor assembly 60 into the play yard 100, the present invention also contemplates other securement means such as hook and loop type fasteners and male and female snap fasteners.

The zipper track 51*a* as shown is a male zipper track while the zipper track 51*b* as shown in the figures is a female zipper track, however, it is contemplated that the zipper track 51*a* could be a female zipper track while the zipper track 51*b* could be a male zipper track. By male zipper track, the present invention is referring to the portion of a zipper assembly that includes a stationary end and an insert pin and by female zipper track, the present invention is referring to the portion of a zipper assembly that includes a zipper slider 61. Although the above sections discuss the use of zippers 51*a* and 51*b* to secure the padded floor assembly 60 into a bassinet mode in play yard 100, the present invention also contemplates other securement means such as hook and loop type fasteners and male and female snap fasteners.

FIG. 8A-8D of the present invention show that the zipper track 51*b* around the upper external periphery of the padded floor assembly 60 includes two zipper sliders 61, located at opposite ends of the of the padded floor assembly 60. The two zipper sliders 61 on the zipper track 51*b* will correspond with two separate portions of the zipper tracks 51*a* of the play yard 100. The present invention also contemplated that the zipper track 51*b* could include just one zipper slider, which would correspond with just one portion of the zipper track 51*a*; or in other embodiments, there could be four zipper sliders, one for each portion of the bassinet connection portions 39, which would then correspond with four separate portions of the zipper tracks 51*a*.

Figure 8C:
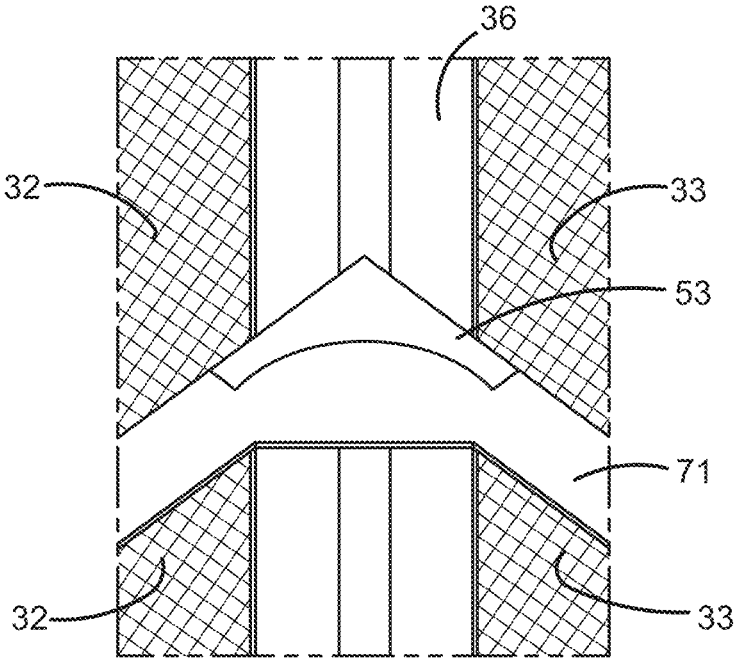
FIG. 8C is a locally perspective enlarged view of a corner of the play yard of FIG. 8A.

As shown in FIG. 8C, above the position of zipper tracks 51*a* is a flap of material 71 that will cover the zipper assembly of 51*a* and 51*b* when the padded floor assembly 60 is in a bassinet position. The flap of material 71 will hide the zipper assembly of 51*a* and 51*b* such that an infant cannot easily access it. FIG. 8C specifically shows a corner of the play yard 100 wherein an additional piece of material 53 is located that provides the user of the play yard 100 with a curved corner to make securing of the padded floor assembly 60 easier when securing the zipper assembly of 51*a* and 51*b* around the corners of play yard 100. Although FIG. 8C shows only one corner located between two portions of the four bassinet connections portions 39, the present invention contemplates that each corner between each portion of the four bassinet connections portions 39 will contain an additional piece of material 53.

Figure 8D:
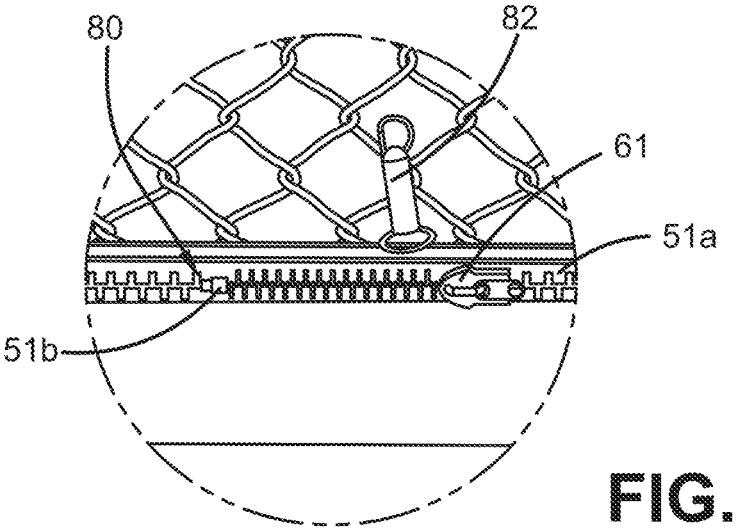
FIG. 8D is a locally perspective enlarged view of the end of a track portion of the play yard of FIG. 8B.

FIG. 8D shows the end of a portion of a zipper track 51*a* secured to corresponding zipper track 51*b*. A small pocket 80 will be formed at the area shown in FIG. 8D when the zipper portions are connected that will allow for the zipper slider 61 to be tucked away therewithin to prevent occupants of the play yard 100 from accessing the zipper slider 61. Too further prevent any tampering with the zipper slider 61, a clasp 82 is secured near the end of each portion of zipper track 51*a*. The clasp 82 will connect with the zipper slider 61 and then both the clasp 82 and the zipper slider 61 will be tucked into pocket 80. Therefore, in embodiments of the present invention wherein there are two zipper sliders 61, there will be two corresponding pockets 80 and two corresponding clasps 82 that will work with the zipper sliders 61 once the padded floor assembly 60 has been set in place.

To place the padded floor assembly 60 into a bassinet position, such as shown in FIG. 8B, the padded floor assembly 60 will need to be secured to the play yard 100. To do this, the zipper track 51*b* along the external upper periphery of the padded floor assembly 60 will need to mate with zipper track 51*a* located along the interior portion of the four bassinet connection portions 39. After securing zipper track 51*b* with 51*a* by zipping the one or more zipper sliders 61 to the one or more ends of zipper track 51*a*, the one or more zipper sliders 61 are connected to a clasp 82 and then tucked into a pocket 80. Once zipper track 51*b* is secured to zipper track 51*a* along the external upper periphery of the padded floor assembly 60, the play yard 100 of the present invention is ready to be used in bassinet mode.

Considering the foregoing, it should be appreciated that the present invention significantly advances the art by providing a play yard with a removable padded floor that is structurally and functionally improved in several ways. While particular embodiments of the invention have been disclosed in detail herein, it should be appreciated that the invention is not limited thereto or thereby since variations on the invention herein will be readily appreciated by those of ordinary skill in the art. The scope of the invention shall be appreciated from the claims that follow.

What is claimed is:

1. A play yard comprising:

a play yard frame and fabric crib body defining an enclosed area, wherein the fabric crib body of the enclosed area includes two side mesh walls, two end mesh walls, and a lower fabric floor;

a padded floor encasement located below the two side mesh walls, the two end mesh walls, and the lower fabric floor, wherein the padded floor encasement includes two padded floor encasement side walls, two padded floor encasement end walls, and a padded floor encasement bottom floor, wherein the lower fabric floor of the enclosed area comprises an upper surface of said padded floor encasement, wherein one or both of said padded floor encasement end walls are openable padded floor encasement end walls, and wherein one or both of said openable padded floor encasement end walls include a stitched shut top portion; and a removable padded floor assembly; wherein the removable padded floor assembly is removably placeable within said padded floor encasement and configured to be positioned adjacent to and beneath the lower fabric floor section.

2. The play yard of claim 1, wherein said play yard frame body includes an upper frame body and a lower frame body; wherein said upper frame body includes four vertical arms, two horizontal side arms, and two horizontal end arms; and wherein said lower frame body includes four corner brackets, four diagonal arms, two lower horizontal arms, and a release mechanism.

3. The play yard of claim 2, wherein each of the horizontal side and horizontal end arms are positioned and secured between two of the four vertical arms; wherein the four diagonal arms are each individually securable within one of the four corner brackets; wherein each of the four diagonal arms and the two lower horizontal arms are each individually securable within the release mechanism; and wherein each of the four vertical arms are individually securable within the four corner brackets to connect said upper frame body to said lower frame body.

4. The play yard of claim 3, wherein said fabric crib body further includes four horizontal padded fabric sections and four vertical fabric sections.

5. The play yard of claim 4, wherein the four horizontal padded fabric sections surround and enclose the horizontal side and horizontal end arms; wherein the four vertical fabric sections surround and enclose the four vertical arms; wherein the lower fabric floor provides for a lower floor portion of the enclosed area; and wherein the two side mesh walls and the two end mesh walls are surround by the four horizontal fabric sections, the four vertical fabric sections, and the lower fabric floor to form wall portions of the enclosed area.

6. The play yard of claim 4, wherein said fabric crib body further includes a bassinet connection portion positioned along a mid-height of each of the side and end mesh walls; wherein each bassinet connection portion includes a bassinet securement means; and wherein said removable padded floor assembly includes a complementary bassinet securement means located around an upper periphery of the padded floor assembly.

7. The play yard of claim 6, wherein said bassinet securement means are removably securable with said complementary bassinet securement means of the padded floor assembly.

8. The play yard of claim 1, wherein one or both of said openable padded floor encasement end walls further include two non-stitched side portions, and a non-stitched bottom portion; wherein each said non-stitched side portion and said non-stitched bottom portion contain securement means; and wherein adjacent said securement means are complementary securement means located on said padded floor encasement side walls and said padded floor encasement bottom floor.

9. The play yard of claim 8, wherein when said securement means on said non-stitched side portions and said non-stitched bottom portion of said one or both of said openable padded floor encasement end walls are matted with said complementary securement means on said padded floor encasement side walls and said padded floor encasement bottom floor, then said one or both of said openable padded floor encasement end walls become closed end walls.

10. The play yard of claim 1, wherein one or both of said padded floor encasement side walls are openable padded floor encasement side walls, wherein one or both of said openable padded floor encasement side walls include a stitched shut top portion, two non-stitched side portions, and a non-stitched bottom portion; wherein each said non-stitched side portion and said non-stitched bottom portion contain securement means; and wherein adjacent said securement means are complementary securement means located on said padded floor encasement end walls and said padded floor encasement bottom floor.

11. The play yard of claim 10, wherein when said securement means on said non-stitched side portions and said non-stitched bottom portion of said one or both of said openable padded floor encasement side walls are matted with said complementary securement means on said padded floor encasement end walls and said padded floor encasement bottom floor, then said one or both of said openable padded floor encasement side walls become closed side walls.

12. The play yard of claim 1, wherein said removable padded floor assembly includes a support board assembly, a foam padding assembly placed on said support board assembly, a cloth cover surrounding, and encasing said support board assembly and said foam padding assembly, and four floor securement means located at corners of the removable padded floor assembly.

13. The play yard of claim 12, wherein the support board assembly is a four-piece support board assembly and wherein the foam padding assembly is a four-piece foam padding assembly.

14. The play yard of claim 12, wherein the padded floor encasement bottom floor contains at least two complementary padded floor securement means located along an outside surface of the bottom floor, and wherein said floor securement means of the padded floor assembly will mate with said complementary floor securement means located along the outside surface of the bottom floor when said removable padded floor assembly is removably placed within said padded floor encasement.

15. A play yard comprising:

a play yard frame and fabric crib body defining an enclosed area, wherein the fabric crib body of the enclosed area includes two side mesh walls, two end mesh walls, and a lower fabric floor;

a padded floor encasement located below the two side mesh walls, the two end mesh walls, and the lower fabric floor, wherein the padded floor encasement includes two padded floor encasement side walls, two padded floor encasement end walls, and a padded floor encasement bottom floor, wherein the lower fabric floor section of the enclosed area comprises an upper surface of said padded floor encasement, wherein one or both of said padded floor encasement side walls are openable padded floor encasement side walls, and wherein one or both of said openable padded floor encasement side walls include a stitched shut top portion; and a removable padded floor assembly; wherein the removable padded floor assembly is removably placeable within said padded floor encasement and configured to be positioned adjacent to and beneath the lower fabric floor section.

* * * * *